United States Patent [19]

Amano et al.

[11] 4,384,506

[45] May 24, 1983

[54] POLYPHONIC ELECTRONIC MUSICAL INSTRUMENT PRODUCING PROMINENT SOLO TONE

[75] Inventors: Takehisa Amano; Hideo Suzuki, both of Hamamatsu, Japan

[73] Assignee: Nippon Gakki Seizo Kabushiki Kaisha, Japan

[21] Appl. No.: 300,402

[22] Filed: Sep. 8, 1981

[30] Foreign Application Priority Data

Sep. 20, 1980 [JP] Japan ..... 55-131079

[51] Int. Cl.[3] ..... G10H 1/057; G10H 1/22; G10H 1/46; G10H 7/00

[52] U.S. Cl. ..... 84/1.26; 84/1.27; 84/DIG. 2

[58] Field of Search ..... 84/1.01, 1.13, 1.24, 84/1.25, 1.26, 1.27, DIG. 2

[56] References Cited

U.S. PATENT DOCUMENTS 3,610,799 10/1971 Watson ..... 84/1.01
4,148,017 4/1979 Tomisawa ..... 84/1.01 X
4,192,211 3/1980 Yamaga et al. ..... 84/1.01
4,218,948 8/1980 Nakada et al. ..... 84/1.01
4,321,850 3/1982 Oya et al. ..... 84/1.01

*Primary Examiner*—Stanley J. Witkowski
*Attorney, Agent, or Firm*—Remy J. VanOphem

[57] ABSTRACT

An electronic musical instrument of a polyphonic type comprises, first tone generating means capable of producing, in a first musical tone property, a plurality of musical tones respectively corresponding to a plurality of depressed keys, and further comprises second tone generating means capable of producing, in a second musical tone property, a musical tone corresponding to a specific key selected from said depressed keys in accordance with a predetermined standard of selection. The first musical tone property is set to be suitable for ensemble performance, whereas the second musical tone property is set to be suitable for solo performance. Among the musical tones produced by the first tone generating means, the one corresponding to the specific key is made less prominent than the ones corresponding to the other depressed keys.

8 Claims, 12 Drawing Figures

POLYPHONIC ELECTRONIC MUSICAL INSTRUMENT PRODUCING PROMINENT SOLO TONE

BACKGROUND OF THE INVENTION

This invention relates to a polyphonic electronic musical instrument in which a musical tone of a specific one of a plurality of simultaneously depressed keys is produced prominently, that is clearly and distinctly.

An electronic musical instrument has already been well known in the art in which the musical tones of a plurality of depressed keys are produced in a first musical tone property (for example a first tone color, a first envelope shape, etc.) while the musical tone of a specific one of these depressed keys (for example, highest note or iowest note key) is produced in a second musical tone property (for example, a second tone color, a second envelope shape, etc.) which is different from the first musical tone property so as to make only the musical tone of the specific depressed keys to be especially clear and distinct among a plurality of musical tones produced simultaneously thereby providing cheerful performance effect.

Such electronic muscial instrument is constructed as shown in FIG. 1, as disclosed, for example, in U.S. Pat. No. 4,218,948. More particularly, depressed keys of a keyboard 1 are detected by a depressed key detector 2 to produce key informations in the form of key codes, for example corresponding to the depressed keys, and the key informations are assigned to predetermined tone production channels in a key assigner 3. The key informations assigned to respective tone production channels are supplied to a first tone signal generator 4 to form musical tone signals corresponding to the depressed keys in a first musical tone property. The key informations assigned to respective tone production channels are also applied to a special note detector 5 for detecting a key information corresponding to a specific depressed key out of respective key informations so as to apply only the key information corresponding to the specific depressed key to a second tone signal generator 6 that forms a musical tone signal corresponding to the specific depressed key in a second musical tone property. The musical tone signals formed by the first and second tone generators 4 and 6 are applied to a sound system 7 to be produced as musical tones.

With this construction, however, as the musical tone corresponding to the specific depressed key is produced by the sound system 7 in both of the first and second musical tone properties or sounding manners (first and second tone colors, for example), the musical tone of the second tone color (hereinafter called a solo type musical tone) would be masked by a musical tone of the first tone color (hereinafter called an orchestra type musical tone) so that it is impossible to make the solo type musical tone to be especially distinct.

SUMMARY OF THE INVENTION

Accordingly, it is an object of this invention to provide an improved polyphonic electronic musical instrument of the type described above and capable of making the solo type musical tone to be more prominent.

This object can be accomplished by providing a polyphonic electronic musical instrument comprising a plurality of keys, first tone generating means capable of producing, in a first musical tone property, a plurality of musical tones respectively corresponding to a plurality of depressed keys among the keys, second tone generating means capable of producing, in a second musical tone property, a musical tone corresponding to a specific key selected from the depressed keys in accordance with a predetermined standard of selection, and modifying means for making a musical tone to be produced by the first tone generating means corresponding to the specific key to be less prominent than musical tones to be produced by the first tone generating means corresponding to the other depressed keys.

DESCRIPTION OF THE PREFERRED EMBODIMENTS

Figure 2:
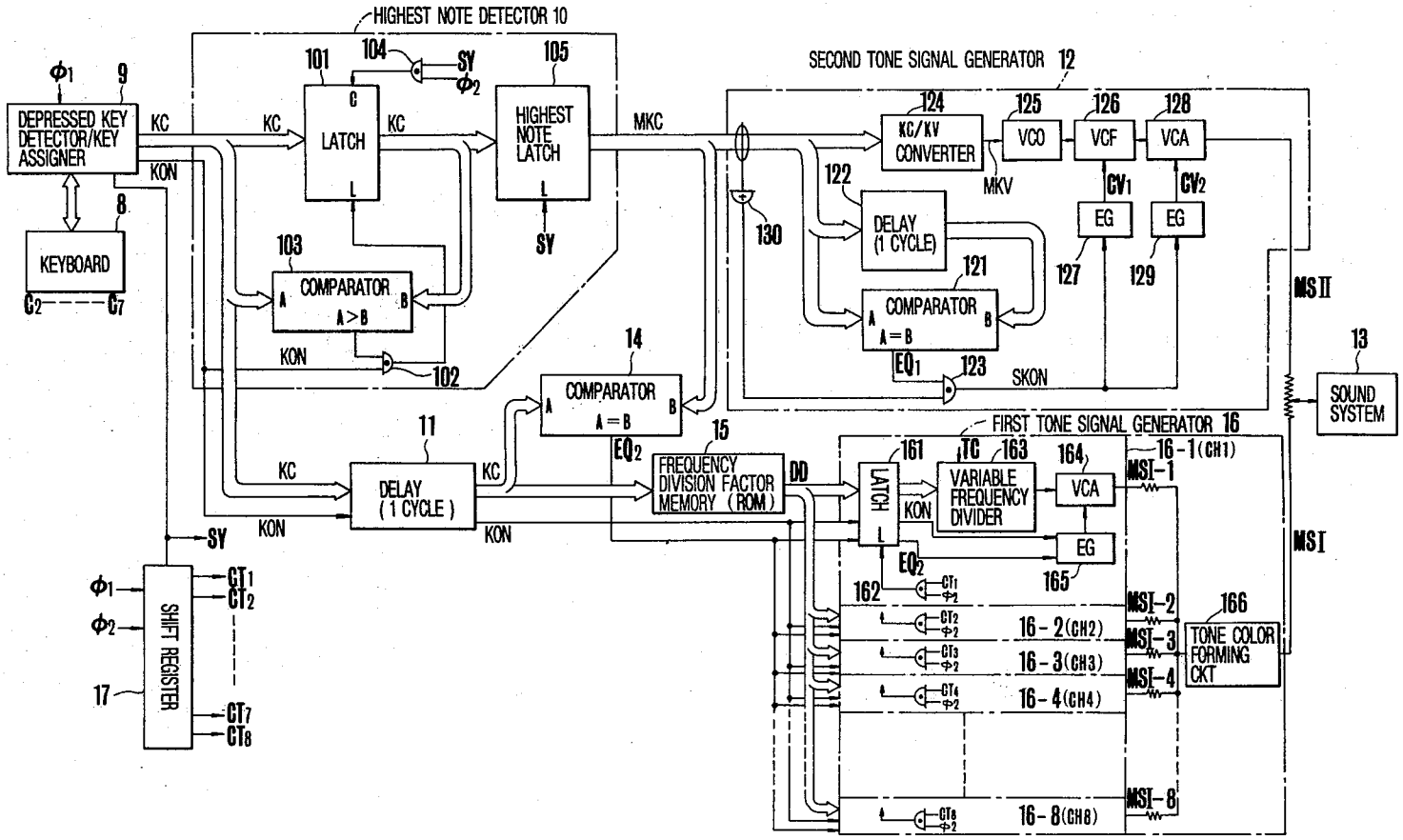
FIG. 2 is a block diagram showing a first embodiment of the electronic musical instrument according to this invention.
Figure 3:
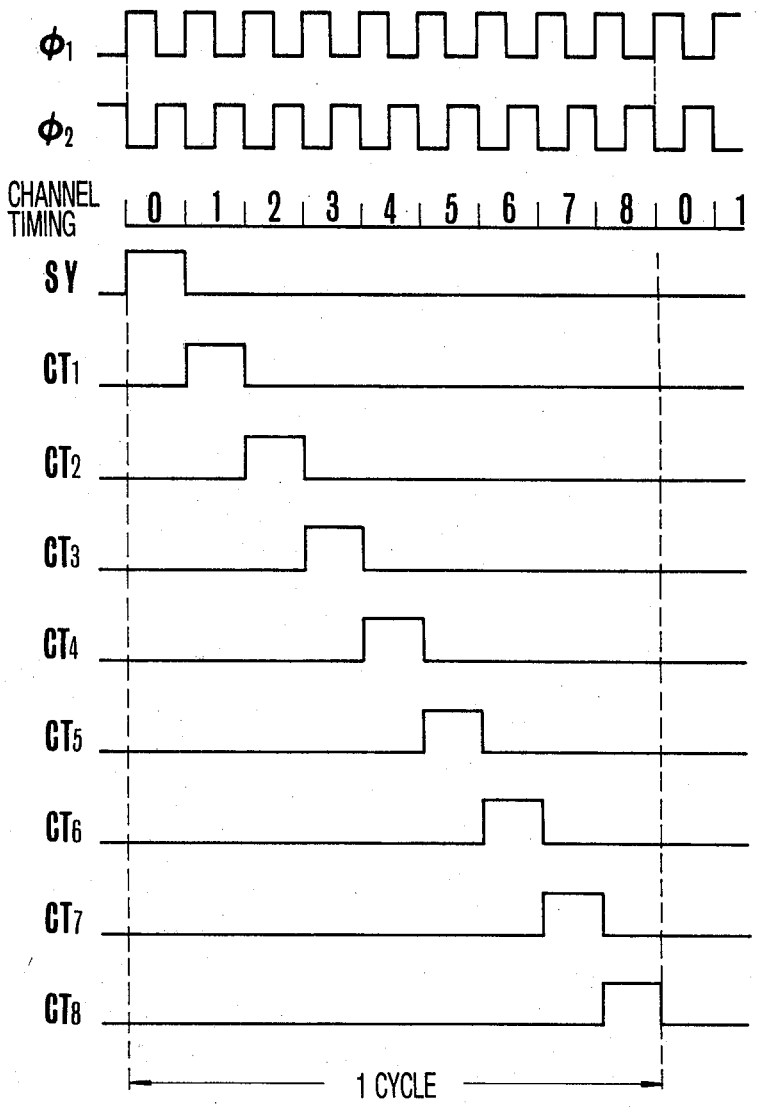
FIG. 3 is a timing chart showing the time relationship of various timing signals utilized in the first embodiment.

FIG. 2 shows a first embodiment of this invention which comprises a so-called mono-manual keyboard 8 in which keys corresponding to note C2 through note C7 are arrayed in one manual; and a depressed key detector/key assigner 9 which detects depressed keys of the keyboard by producing key codes KC indicative of the depressed keys and for assigning the key codes KC to either ones of a plurality of musical tone production channels of a number (in this example 8) corresponding to the maximum number of the tones simultaneously produced. The key codes KC assigned to respective channels CH1 through CH8 and key-on signals KON represents the depressed key states of respective channels (which are "1" when keys are depressed but "0" when the keys are released) are recurrently produced respectively in synchronism with the first through eighth channel timings among time divisioned timings comprising 9 channel timings per one cycle. The depressed key detector/key assigner 9 produces a signal (hereinafter termed a synchronizing signal SY) which becomes "1" only at the 0th channel timing. The key codes KC are set such that their values increase with the tone pitch. Each channel timing is equal to one period of a clock pulse $\phi_1$ (FIG. 3). The detail of the depressed key detection and tone production assignment circuit is desclosed in U.S. Pat. No. 4,148,017, while the key assigner is disclosed in U.S. Pat. No. 4,192,211.

The key codes KC and key-on signals KON outputted from the depressed key detector/key assigner 9, on the time division basis, are applied in parallel to a highest note detector circuit 10 and a delay circuit 11.

The highest note detector 10 is constructed to detect a key code KC corresponding to the highest note among the key codes KC in respective channels CH1 through CH8 and to send out the detected key code KC as the highest note key code MKC. More particularly, a latch circuit 101 is provided to be supplied with an output "1" of an AND gate circuit 102 inputted an output A>B of a comparator 103 and a key-on signal KON to latch a key code KC outputted from the depressed key detector/key assigner 9. The latch circuit 101 is cleared in the later half of the 0th channel timing when it is supplied with the output of an AND gate circuit 104 inputted with the synchronous pulse SY and a clock pulse $\phi_2$ (see FIG. 3).

The comparator 103 compares a key code KC outputted from the depressed key detector/key assigner 9 and a key code KC' latched in the latch circuit 101 at each channel timing to produce "1" at its terminal A>B only when KC>KC'. For this reason, during an interval between the termination of the eighth channel timing and the commencement of the first channel timing of the next cycle, the key code MKC of the highest note of the presently depressed keys (KON="1") among the key codes KC of respective channels CH1 through CH8, which are sequentially sent out between the first and the eighth channel timings would be latched.

A highest note latch circuit 105 is supplied with the synchonizing pulse SY to latch the highest note key code MKC outputted from the latch circuit 101 at the time of commencing the 0th channel timing at which the synchronizing pulse SY builds up. Consequently, the highest note detector 10 continues to output the highest note key code MKC of the previous cycle after being delayed one cycle. In other words, a key code KC corresponding to the highest note depressed key among a plurality of depressed keys of the keyboard 8 would be outputted as the highest note key code MKC. Then, the highest note key code MKC is applied to a second tone signal generator 12.

The second tone signal generator 12 forms a tone signal MSII having a tone pitch represented by the highest note key code MKC and having the second tone property (solo type tone color) and supplies the tone signal MSII to a sound system 13.

The detail of the construction and operation of the second tone signal generator 12 will be described hereunder. Thus, the highest note key code MKC is supplied to the input terminal A of a comparator 121, and to the input B of the comparator 121 after being delayed one cycle (the 0th channel timing through the eighth channel timing) by a delay circuit 122. When the key codes supplied to both inputs A and B coincide with each other, a coincidence signal EQ1 ("1") is produced from the output terminal A=B. This coincidence signal EQ1 is supplied to one input of an AND gate circuit 123 with the other input supplied with the output of an OR gate circuit 130 inputted with respective bits of the highest note key code MKC, so that the AND gate circuit 123 outputs a solo voice key-on signal SKON.

The reason that the coincidence signal EQ1 of the comparator 121 is not used as the solo voice key-on signal SKON as it is but instead the signal SKON is produced only when the output of the OR gate circuit 130 is to prevent the solo voice key-on signal SKON from being outputted when no key is depressed on the keyboard 8.

The highest note key code MKC outputted from the highest note detector 10 corresponding to the highest note depressed key and is converted into a corresponding analogue voltage MKV by a key-code-to-voltage converter 124 and then applied to a voltage controlled oscillator (VCO) 125 to control the oscillation frequency thereof. Consequently VCO 125 produces a tone source signal having a frequency corresponding to the analogue voltage MKV, that is the tone pitch of the highest note depressed key and the tone source signal is applied to a VCF 126 which forms a musical tone signal by applying a predetermined tone color to the tone source signal based on an envelope waveform signal outputted from an envelope generator (EG) 127. The musical tone signal outputted from the VCF 126 is amplified by a voltage controlled amplifier (VCA) 128, the gain thereof being varied in accordance with the envelope waveform signal outputted from another envelope generator (EG) 129 to apply an envelope to the tone signal. The VCA 128 produces a tone signal corresponding to the highest note depressed signal with the second musical tone property, and the tone signal is applied to the sound system 13 as the second tone signal MSII.

The delay circuit 11 outputs the key code KC and the key-on signal KON produced by the depressed key detector/key assigner 9 after delaying them by one cycle. Thus, the delay circuit 11 operates in synchronism with the output cycle of the highest note detector 10. The key code KC outputted from the delay circuit 11 is applied to the input terminal A of the comparator 14 and a frequency division factor memory (ROM) device 15. The highest note key code MKC outputted from the highest note detector 10 is applied to the input terminal B of the comparator 14. When the key codes supplied to both input terminals A and B of the comparator 14 coincide with each other, a coincidence signal EQ2 ("1") is outputted from the output terminal A=B of the comparator 14. Thus, the output terminal A=B produces the coincidence signal EQ2 ("1") having a time width of one channel timing each time a channel timing signal is reached to which the highest note key code MKC is assigned to each cycle.

The addresses of the frequency division factor ROM 15 is designated by the key code KC outputted from the delay circuit 11 and frequency division factor data corresponding to respective key codes are stored in respective addresses of the ROM 15. Accordingly, when the key codes KC of the channels CH1 through CH8 are sequentially supplied to the frequency division factor ROM 15, on the time division basis, the frequency division factor ROM 15 produces corresponding frequency division factor data DD in response to the applied timing signals, and these frequency division factor data DD are supplied in parallel to eight discrete tone generating circuits 16-1, 16-2 . . . 16-8 which constitute the first tone signal generator 16.

The construction and the operation of the first tone generator 16 will now be described in detail as follows. As above described, the first tone generator 16 is constituted by the tone generating circuits 16-1 through 16-8 of the same construction to which are distributed the frequency division factor data DD and key-on signals KON of respective channels CH1 through CH8 respectively outputted from the frequency division factor ROM 15 and the delay circuit 11, in accordance with the 8 group channel timing signal CT1 through CT8 (see FIG. 4) outputted from respective stages of an 8-stage/1-bit shift register 17 driven by clock pulses $\phi_1$ and $\phi_2$ (see FIG. 4). The tone generating circuits 16-1 through 16-8 respectively correspond to channels CH1 through CH8 so as to form and output tone signals in the first musical tone property corresponding to the key codes KC assigned to respective channels.

The detail of the construction of the tone generating circuits 16-1 through 16-8 will now be described with reference to the circuit 16-1 as a typical one. This circuit 16-1 comprises a latch circuit 161 supplied with a key-on signal KON, and a coincidence signal EQ2 and the output of an AND gate circuit 162 inputted with the clock pulse $\phi_2$ and the channel timing signal CT1 corresponding to the first channel CH1 (in other circuits 16-2 through 16-8, the AND gate circuits are inputted with the clock pulse $\phi_2$ and one of channel timing signals CT2 through CT8) so that the latch circuit 161 latches the frequency division factor data DD for the assigned key, the key-on signal KON and the coincidence signal EQ2 when the output of the AND gate circuit 162 builds down. The musical tone signal generating circuit 16-1 further comprises a variable frequency division circuit 163 which divides the frequency of a tone clock signal TC at a frequency division factor determined by a frequency division factor data DD outputted from the latch circuit 161, thus producing a tone source signal corresponding to the tone pitch of the depressed key (key code KC) assigned to the first channel CH1.

Figure 4:
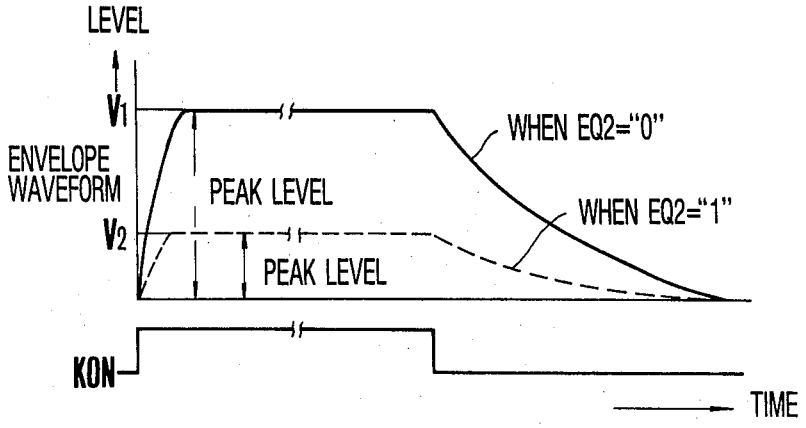
FIG. 4 shows the envelope waveform outputted from the envelope generator of the first tone signal generator shown in FIG. 2.

The gain of a VCA 164 is controlled in accordance with the envelope waveform outputted from an envelope generator (EG) 165 so as to apply an envelope control to the tone source signal supplied from a variable frequency divider 163. The EG 165 is supplied with a key-on signal KON, and a coincidence signal EQ2 outputted from the latch circuit 161 to form a predetermined envelope waveform in response to the generation of the key-on signal KON="1". In this case, the waveform of the envelope waveform is varied according to the state of the coincidence signal EQ2. Thus, for example, when the coincidence signal EQ2 is "0", the EG 165 generates an envelope waveform having a peak voltage at voltage V1 as shown in FIG. 4, whereas when the coincidence signal EQ2 is "1", it produces an envelope waveform having a peak level at voltage V2 (where $V2<V1$). Consequently, the gain of the VCA 164 is smaller when the coincidence signal EQ2 is "1" than when EQ2 is "0" thereby lowering the level of the tone source signal outputted from the VCA 164.

As above described the other tone signal generating circuits 16-2 through 16-8 have the same construction as the tone signal generating circuit 16-1.

The tone signals MSI-1 through MSI-8 thus produced by the tone generating circuits 16-1 through 16-8 are mixed together and then applied to a tone color forming circuit 166 to form a tone signal MSI of the orchestra type color corresponding to the first tone property and then the tone signal MSI is supplied to the sound system 13.

Figure 5:
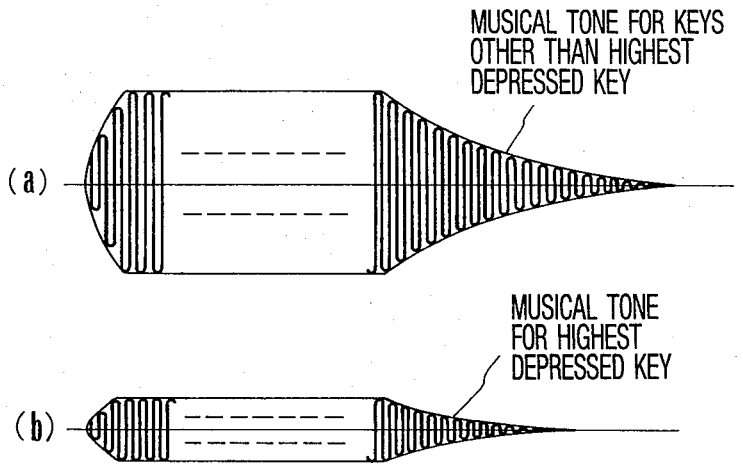
FIG. 5 shows waveforms of the musical tone signals outputted from the first musical tone signal generator shown in FIG. 2.

Suppose now that four keys C3, E3, G3 and G4 of the keyboard 8 are depressed simultaneously and the key codes KC(C3), KC(E3), KC(G3) and KC(G4) corresponding to respective depressed keys are assigned respectively to the first to fourth channels CH1 through CH4. Then the highest note detector 10 outputs the key code KC(G4) of the key G4 corresponding to the highest note depressed key among the simultaneously depressed keys C3, E3, G3 and G4 as the highest note key code MKC which is applied to the second tone signal gnerator 12 thus causing it to produce a tone signal MSII in the second musical tone property corresponding to the depressed key G4. On the other hand, in the first tone signal generating circuit 16-1, the tone signal generating circuits 16-1 through 16-4 produce tone source signals MSI-1 through MSI-4 respectively corresponding to the depressed keys C3, E3, G3 and G4 which are sent out as tone signals MSI in the first musical tone property via the tone color forming circuit 166. At this time, the comparator 14 produces a coincidence signal EQ2 ("1") in synchronism with the fourth channel timing corresponding to the fourth channel CH4 assigned with the key code KC (G4), and since this coincidence signal EQ2 is applied to the tone generating circuit 16-4 (a coincidence signal EQ2 of "0" is applied to the other tone generating circuits 16-1 through 16-3, and 16-5 through 16-8), the tone volume level of the tone signal MSI-4 outputted from the tone signal generating circuit 16-4 would decrease. Consequently, the tone volume level of the musical tone of the key G4 corresponding to the highest note depressed key among the musical tones produced in the first musical tone property corresponding to the depressed keys C3, E3, G3 and G4 becomes much lower than those of the other musical tones as shown in FIG. 5.

Thus, according to this embodiment among the tone signals MSI outputted from the first tone signal generator 16, since the level of the musical tone signal having the same tone pitch as the tone signal MSII outputted from the second tone signal generator 12 is limited to a low level, although the musical tones of the same tone pitch are produced in the first and second musical tone properties the musical tone in the first musical tone property has any appreciable effect, thus making the musical tone (solo voice type musical tone) in the second musical tone property to be more clear and distinct.

Figure 1:
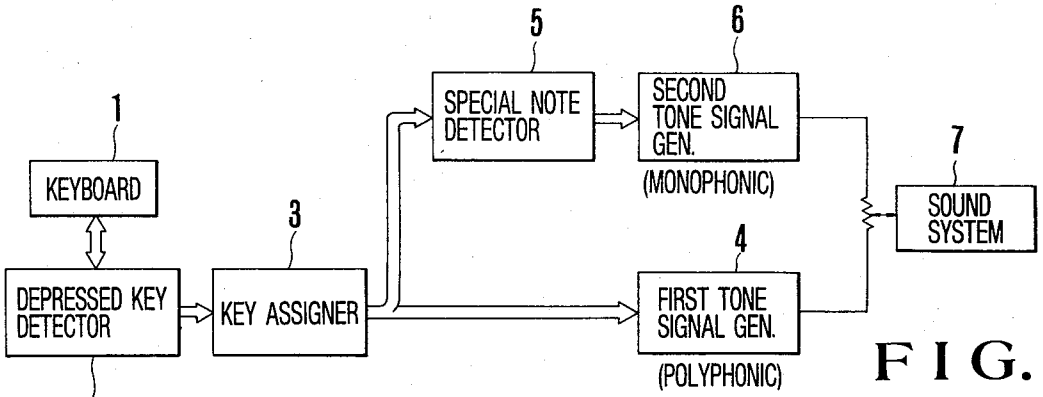
FIG. 1 PRIOR ART
FIG. 1 is a block diagram showing one example of a prior art two group tone generation type electronic musical instrument.
Figure 6:
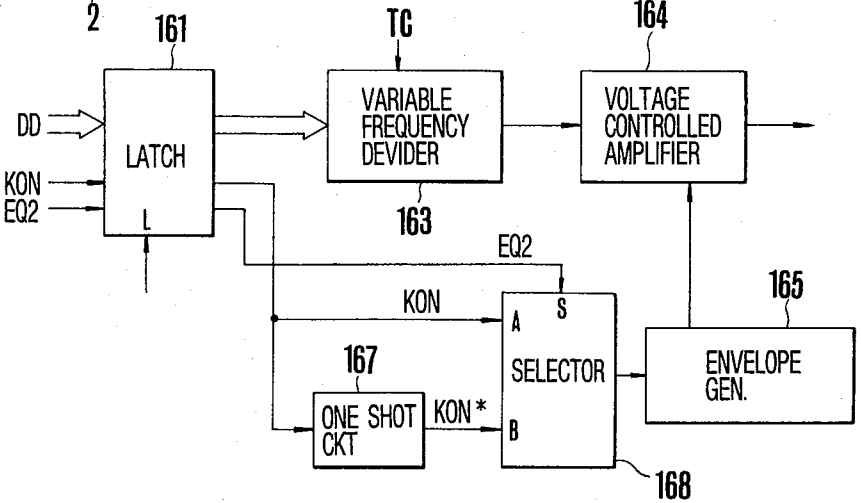
FIG. 6 is a block diagram showing a modification of the first embodiment shown in FIG. 2.

Although in this embodiment, for the purpose of making more clear and distinct the musical tone produced in the second musical tone property, the peak level of the envelope waveform outputted from the EG 165 in response to the coincidence signal EQ2 was switched to voltage V1 or V2 or varying the gain of the VCA 164, the same object can also be attained by applying the key-on signal KON outputted from the latch circuit 161 directly to a selector 168 or indirectly through a one shot circuit 167 as shown in FIG. 6 and by switching the selector 168 under the control of a coincidence signal EQ2 outputted from the latch circuit 161 for selectively applying the input signals KON and KON* to the EG 165.

Figure 7A:
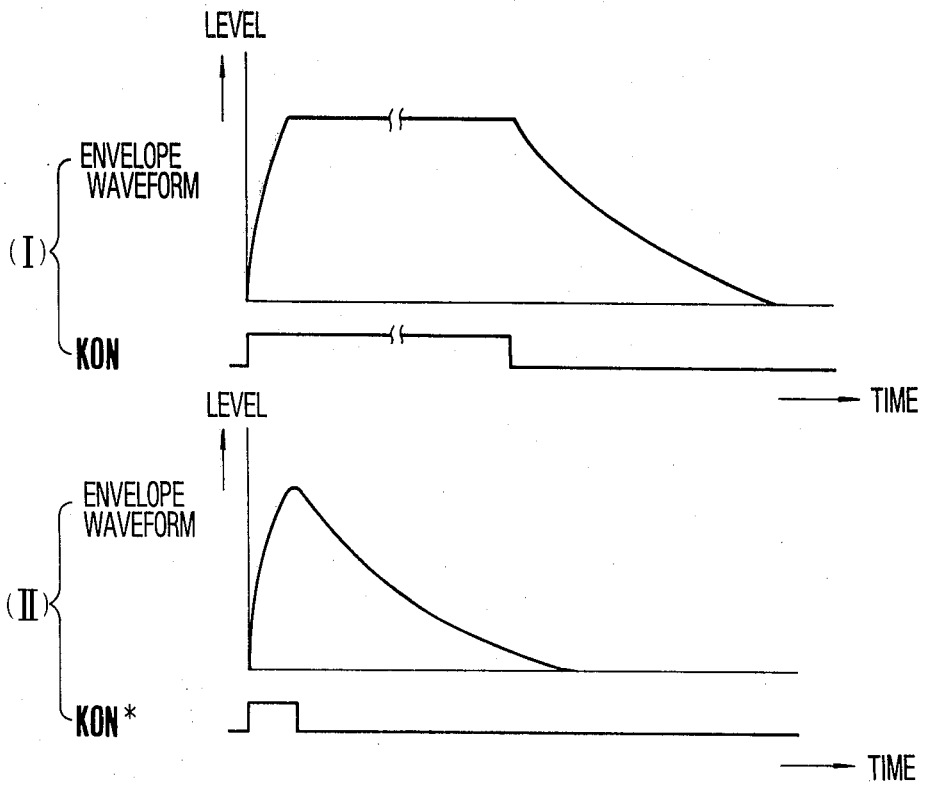
FIG. 7A shows the envelope waveforms outputted from the envelope generator shown in FIG. 6.
Figure 7B:
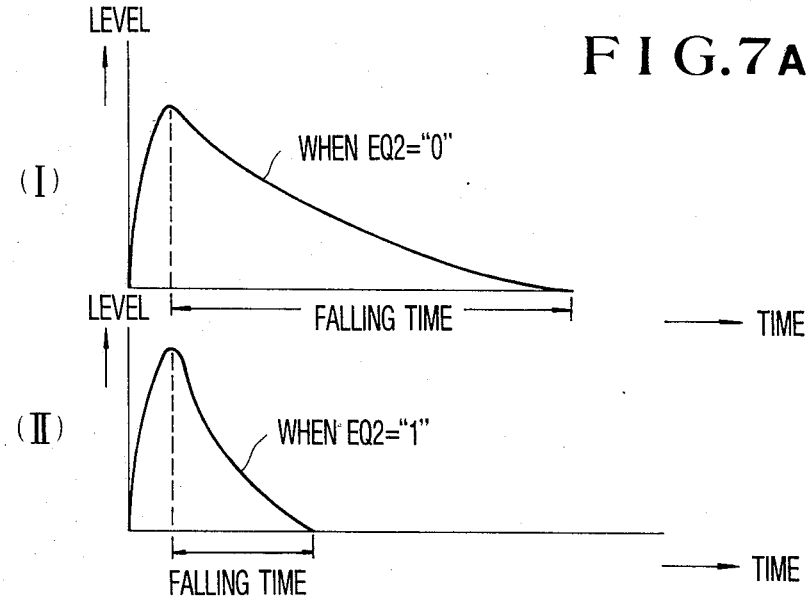
FIG. 7B shows the envelope waveforms outputted from the envelope generator of the first musical tone signal generator shown in FIG. 2.

More particularly, in FIG. 6, when the coincidence signal EQ2 is "0", the selector 168 outputs the key-on signal KON supplied to its input terminal A (which is maintained at "1" while a key is being depressed) with the result that the envelope waveform outputted from the EG 165 maintains its peak level during the key depression as shown in FIG. 7A-I, whereas when the coincidence signal EQ2 is "1" the selector 168 outputs the key-on signal KON* (which becomes "1" for a short time when the key-on signal builds up) applied to the input terminal B with the result that the envelope waveform outputted from the EG 165 rapidly attenuates as shown in FIG. 7A-II, thus greatly shortening the duration of tone generation.

Where the EG 165 is shown in FIG. 2 is constructed to form a percussive type envelope waveform as shown in FIG. 7B, instead of switching the peak level of the envelope waveform according to the coincidence signal EQ2 outputted from the latch circuit 161, the build down time of the envelope waveform may be varied. More particularly, when the coincidence signal EQ2 is "1" the build down time of the envelope waveform is greatly shortened as shown in FIG. 7B-II so as to shorten the tone production interval.

Figure 8:
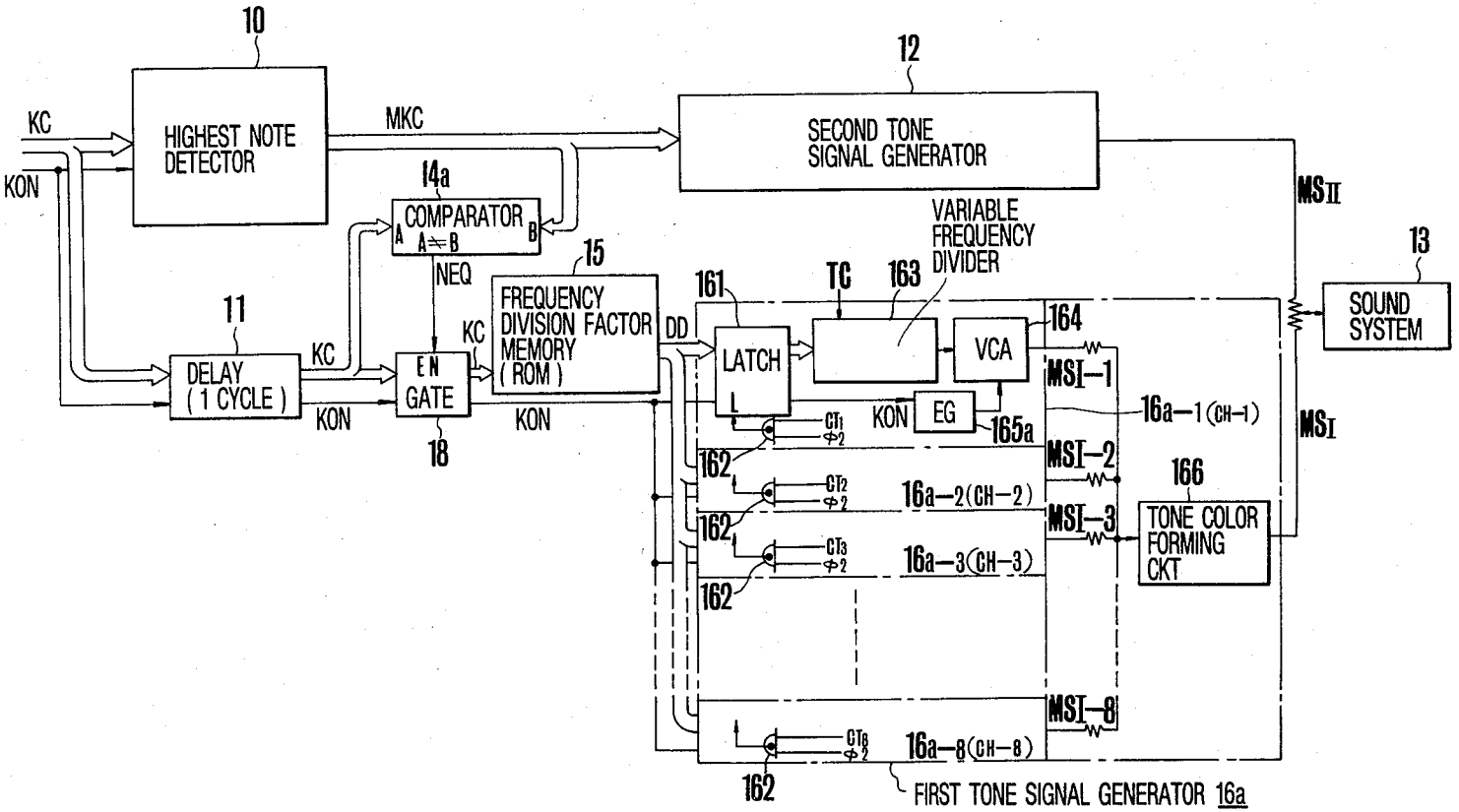
FIG. 8 is a block diagram showing a second embodiment of this invention.

FIG. 8 shows a second embodiment of this invention in which circuit components identical to those utilized in the first embodiment shown in FIG. 2 are designated by the same reference characters.

This second embodiment is characterized in that instead of applying the coincidence signal EQ2 from the comparator 14 to the EG 165 as in FIG. 2, an ON/OFF gate circuit 18 is interposed between the delay circuit 11 and the frequency division factor ROM 15 so as not to apply the key code KC and the key-on signal KON of the channel to which is assigned the highest note key code MKC to the first musical tone signal generator 16 thus inhibiting the tone production of the highest note depressed key in the first musical tone property.

More particularly, the comparator **14*a* shown in FIG. 8 compares the highest note key code MKC outputted from the highest note detector 10 with the key codes KC outputted from the delay circuit 11, on the time division basis, and assigned to respetive channels, and outputs a compared output NEQ of "0" at output A=B at the channel timing at which the body key codes coincide with each other. The gate circuit 18 becomes enabled only when a signal "1" is applied to it enabling terminal EN. Consequently, each time when a channel timing signal corresponding to a channel assigned with the highest note key code MKC is applied, the comparator 14*a* produces a compared signal NEQ of "0", thus preventing all key codes KC and key-on signals KON outputted from the delay circuit 11 by the gate circuit 18 from reaching the frequency division factor ROM 15 or latch circuits 161. As a consequence, no key code KC and key-on signal KON would not be supplied to a tone generating circuit corresponding to a channel assigned with the highest note key code MKC among the tone generating circuits 16*a*-1 through 16*a*-8 of the first tone signal generator 16** so that no tone source signal (tone signal) would be produced.

As above described with the electronic musical instrument shown in the second embodiment, the musical tone corresponding to the highest note depressed key is produced only in the second musical tone property (solo mode) so that the solo type musical tone can be made to be more distinct or prominent.

While in the second embodiment, for the purpose of preventing a tone signal corresponding to the highest note depressed key from being produced by the first tone signal generator **16*a* a gate circuit 18 is provided for intercepting both key code KC and key-on signal KON, only the key-on signal may be intercepted or the outputs of the tone signal generating circuits 16*a*-1 through 16*a*-8** may be intercepted to accomplish the same object.

Figure 9:
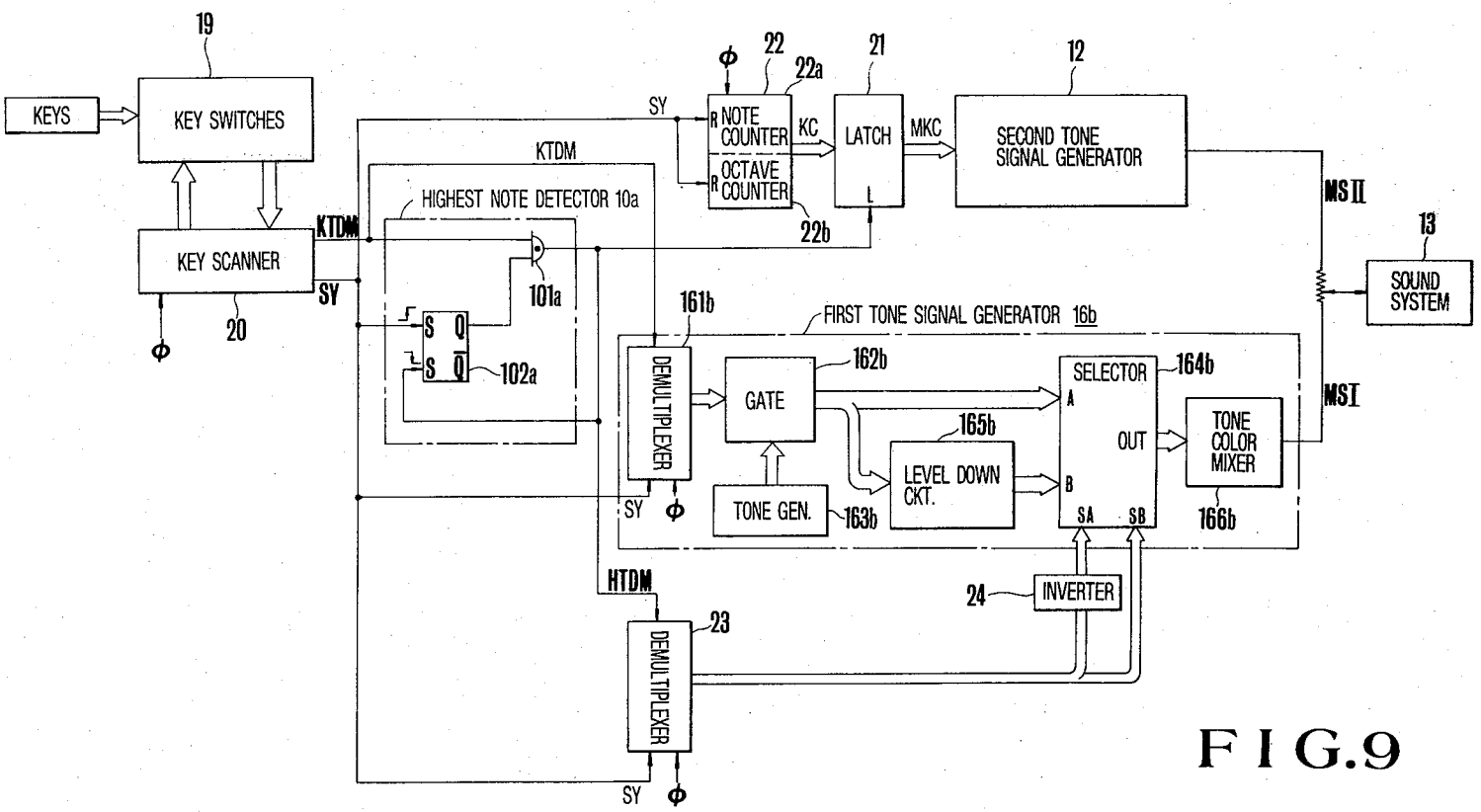
FIG. 9 is a block diagram showing a third embodiment of this invention.

FIG. 9 shows a third embodiment of this invention in which circuit components identical to those used in the first embodiment shown in FIG. 2 are designated by the same reference characters.

Figure 10:
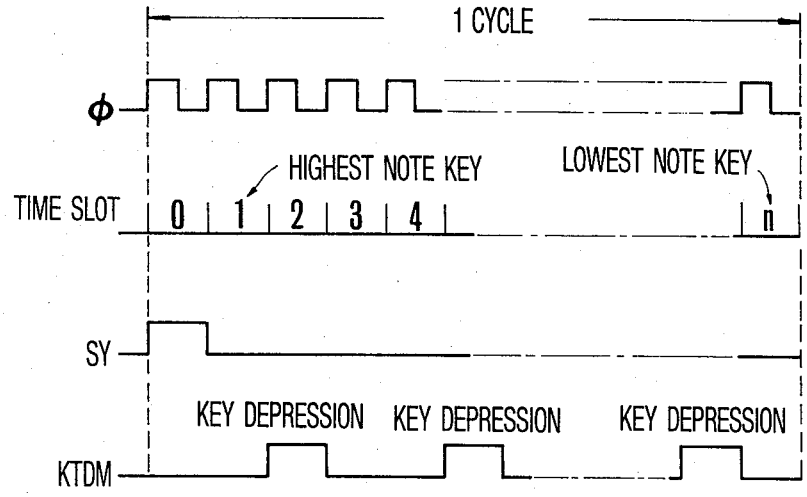
FIG. 10 is a timing chart showing the time relationship of various timing signal utilized in the third embodiment shown in FIG. 9

A key switch circuit 19 shown in FIG. 9 is constituted by n (integer) key switches associated with respective keys of a keyboard. A key scanning circuit 20 is constituted by a counter, not shown, which counts the number of clock pulses $\phi$ and circuits, not shown, which sequentially derive out the outputs of the key switches from the highest note side toward the lowest note side in response to the output of the counter as disclosed in detail in U.S. Pat. No. 3,610,799, for example. The key scanning circuit 20 outputs a time division multiplexed signal KTDM which completes one scanning cycle covering $(n+1)$ time slots each having a time width equal to one period of one clock pulse $\phi$ as shown in FIG. 10. The first to nth time slots of each scanning cycle respectively correspond to the highest note key through the lowest note key of the keyboard and become "1" when the key is depressed, whereas "0" when the key is not depressed. As shown in FIG. 10 the key scanning circuit 20 also produces a synchronizing signal SY which becomes "1" corresponding to the 0th time slot.

The time division multiplexed signal KTDM and the synchronizing signal SY outputted from the key scanning circuit 20 are applied in parallel to a highest note detector circuit **10*a* and a first tone signal generator 16*b*. The highest note detector 10*a* comprises an AND gate circuit 101*a* having one input supplied with the time division multiplexed signal KTDM outputted from the key scanning circuit 20, and an RS flip-flop circuit 102*a* with its Q output supplied to the other input of the AND gate circuit 101*a* which is enabled when the Q output is "1", whereas disenabled when the Q output is "0". The RS flip-flop circuit 102*a* is set at the time of building up of the synchronizing signal SY immediately prior to the commencement of each scanning cycle, and reset when the output "1" of the AND gate circuit 101*a* builds down. Consequently, the AND gate circuit 101*a*** produces a pulse of "1" in response to only the timing of the time slot assigned to the highest note depressed key thereby detecting the highest note.

The output of the highest note detector **10*a* is applied to a latch circuit 21 which is also supplied with the key code KC outputted from a note counter 22 constituted by a scale-of-12 note counter 22*a* which counts the number of clock pulses $\phi$ and a scale-of-m octave counter 22*b* (the number of scale corresponds to the number of octaves) which counts the number of carry outputs of the note counter 22*a*. Counters 22*a* and 22*b* are respectively reset by the synchronizing signal SY immediately prior to the commencement of each scanning cycle. Accordingly, the latch circuit 21** latches a key code KC corresponding to the highest note depressed key at that time as the highest note key code MKC.

The second musical tone signal generator 12 forms and outputs a tone signal MSII having a tone pitch represented by the highest note key code MKC outputted from the latch circuit 21 and the second musical tone property (solo type tone color), and this tone signal MSII is converted into a musical tone by the sound system 13.

The detail of the first musical tone signal generator 16b is as follows. More particularly a demultiplexer 161b is provided to demultiplex the time division multiplexed signal KTDM outputted from the key scanner 20 according to the synchronizing pulse SY and the clock pulse $\phi$ for applying in parallel the demultiplexed signal to the output lines corresponding to the respective keys. The parallel outputs are applied to respective gates of a gate circuit 162b comprising a plurality of discrete gate circuits respectively controlled by the parallel outputs of the demultiplexer 161b and inputted with tone source signals produced by a tone generator 163b.

When a plurality of keys of a keyboard are simultaneously depressed, the signals on the output lines corresponding to the depressed keys among a plurality of output lines of the demultiplexer 161b become "1" so that the gate circuit 162b produces tone source signals corresponding to the depressed keys. Then the output lines of the gate circuit 162b are divided into two groups, one group being connected directly to the input terminal group A of the selector 164b, while the other group connected to the input terminal group B of the selector 164b after being attenuated a definite amount through a level down circuit 165b in the form of a potentiometer resistor for example. The selector 164b is provided with two input terminal groups each including a plurality of input terminals of the same number as the keys; output terminal groups OUT each including a plurality of output terminals of the same number as the keys; and two control terminal groups SA and SB for applying to the output terminals of the output terminal group OUT a transfer control signal that determines that which one of the signals supplied to the output terminal groups A and B is to be outputted. Each of the control terminal groups SA and SB comprises a plurality of control terminals of the same number as the keys. When a signal "1" supplied to either one of the control terminals of the control terminal group SA, the output terminal corresponding to that control input outputs a tone source signal supplied to the input terminal group A, that is a tone source signal at a normal level, whereas when a signal "1" is applied to either one of the control terminal of the control terminal group SB, the output terminal corresponding to that control terminal produces a tone source signal applied to the input terminal group B, that is a tone source signal at a lowered level. The switching of the selector 164b is controlled by the output of the demultiplexer 23. The demultiplexer 23 has the same construction as that of the demultiplexer 161b and converts the time division multiplexed signal KTDM (which becomes "1" at the time slot of the highest note depressed key) outputted from the highest note detector 10a into corresponding parallel signals. More particularly, the multiplexer 23 is provided with a plurality of output terminals corresponding to respective keys so that the signal "1" appears on only the output terminal always corresponding to the highest note depressed key. The parallel outputs of the demultiplexer 23 are divided into two groups, one applied to the control terminal group SA through an inverter group 24, while the other directly to the control terminal group SB. Consequently, when a plurality of keys are simultaneously depressed the parallel signals supplied to the control terminal groups SA of the selector 164b become "1" except the bit corresponding to the highest note depressed key, whereas among the parallel signals supplied to the control terminal group SB, only the bit corresponding to the highest note depressed key becomes "1". As a consequence, among various tone source signals outputted from the output terminal groups OUT of the selector 164b, the level of the tone source signal corresponding to the highest note depressed key is lower than that of the other tone source signals. Then, the tone source signals outputted from the selector 164b are suitably mixed together in a tone color mixer 166b and then applied to the sound system 13 as the tone signal MSI in the first musical tone property (orchestra type tone color).

As above described according to this embodiment the level of a musical tone signal having the same tone pitch as the tone signal MSII produced by the second tone signal generator 12 among tone signals MSI outputted from the first tone signal generator 16b is limited to a low value so that even though musical tone having the same tone pitches are produced in two musical tone properties the musical tone in the first musical tone property has a little musical effect with the result that the musical tone (solo type musical tone) in the second musical tone property is made to be clear and distinct, that is dominant.

Figure 11:
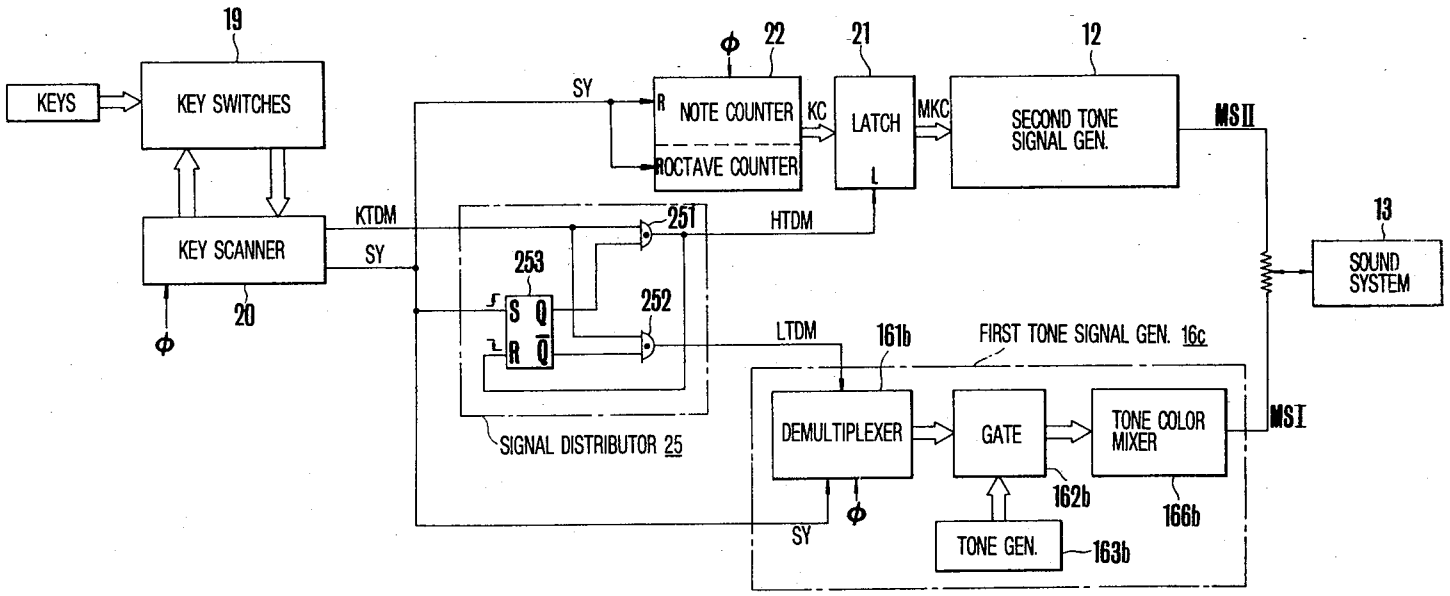
FIG. 11 is a block diagram showing a fourth embobidment of this invention.

FIG. 11 shows a fourth embodiment of this invention in which component elements identical to those utilized in the third embodiment shown in FIG. 9 are designated by the same reference characters.

The fourth embodiment is characterized in that the selector 164b, the level down circuit 165b, the demultiplexer 23, the inverter group 24, and the highest note detector 10a shown in FIG. 9 are substituted by a signal distributor 25 for preventing the key information corresponding to the highest note depressed key from being applied to the first tone signal generator 16c. Thus, the time division multiplexed signals KTDM outputted from the key scanner 20 and representing the depressed states of all keys are divided by the signal distributor 25 into a high range time divisioned and multiplexed signal HTDM representing the depressed states of the keys from the highest note key in the keyboard to the highest depressed key, and a low range time division multiplexed signal LTDM indicative of the depressed states of various keys ranging from a key lower next to the highest depressed key to the lowest note key in the keyboard. More specifically the signal distributor 25 is constituted by two AND gate circuits 251 and 252 connected in parallel in the output line of the time division multiplexed signal KTDM outputted from the key scanner 20 and an RS flip-flop circuit 253 adapted to selectively controlling the AND gate circuits 251 and 252 which are enabled respectively when the Q and $\overline{Q}$ outputs of the RS flip-flop circuit 253 are "1" whereas disenabled respectively when the Q and $\overline{Q}$ outputs are "0". The RS flip-flop circuit 253 is set at the time of building up of the synchronizing signal SY and reset when the output signal "1" of the AND gate circuit 251 builds down. Consequently, the AND gate circuit 251 is enabled during the interval between the second time slot (No. 1) and the time slot corresponding to the highest depressed key, whereas the AND gate circuit 252 is enabled only during the interval between the time slot corresponding to the key lower next to the highest depressed key and the time slot corresponding to the lowest note key in the keyboard with the result that it becomes possible to divide the signal KDM into two signals HTDM and LTDM as above described.

As above described, according to this modification the information regarding the highest depressed key would never be supplied to the first tone signal generator 16c so that the musical tone corresponding to the highest depressed key is produced only in the second musical tone property, thereby making the solo voiced musical tone corresponding to the highst depressed key to be clear and distinct.

Although in the foregoing first to fourth embodiments the highest depressed key was described as the specific depressed key, the lowest note depressed key may alternatively be used as the specific depressed key. The construction of the musical tone signal generators 12, 16, 16a through 16c is not limited to those described above but may be of any desired construction.

As above described according to this invention among the musical tones (corresponding to the depressed keys) generated by the first tone generating means, the property of the musical tone having the same tone pitch as that of the musical tone produced by the second musical tone generating means is varied suitably so as to make the musical tone produced by the second tone producing means not to be masked but to be clear and distinct thererby providing a pleasant performance effect.

What is claimed is:

1. A polyphonic electronic musical instrument comprising:

a plurality of keys;

first tone generating means capable of producing, in a first musical tone property, a plurality of musical tones respectively corresponding to a plurality of depressed keys among said keys;

second tone generating means capable of producing, in a second musical tone property, a musical tone corresponding to a specific key selected from said depressed keys in accordance with a predetermined standard of selection; and modifying means for making a musical tone to be produced by said first tone generating means corresponding to said specific key to be less prominent than musical tones to be produced by said first tone generating means corresponding to the other depressed keys.

2. A polyphonic electronic musical instrument according to claim 1 wherein said modifying means is means for lowering a tone volume level of the musical tone corresponding to said specific key.

3. A polyphonic electronic musical instrument according to claim 2 wherein said means for lowering the tone volume level includes a variable gain amplifier.

4. A polyphonic electronic musical instrument according to claim 2 wherein said means for lowering the tone volume level comprises means for attenuating a tone source signal or a musical tone signal produced by said first tone generating means.

5. A polyphonic electronic musical instrument according to claim 1 wherein said modifying means comprises means for rapidly attenuating an envelope waveform applied to the musical tone corresponding to said specific key.

6. A polyphonic electronic musical instrument according to claim 1 wherein further comprises depressed key detecting means for respectively sending control signals to said modifying means while keys are depressed thereby to delivering out the musical tones of the depressed keys with respective envelope shapes, and means for interrupting the control signal for said specific key to rapidly attenuate the envelope shape of the musical tone produced by said first tone generating means corresponding to said specific key.

7. A polyphonic electronic musical instrument according to claim 1 wherein said modifying means comprises means for prohibiting the musical tone corresponding to said specific key among said musical tones.

8. A polyphonic electronic musical instrument according to claim 7 which further comprises means for producing key signals representing the depressed keys, and wherein said tone generating means produce musical tones according to said respective key signals and wherein said prohibiting means comprises means for preventing the key signal corresponding to said specific key from being applied to said first tone generating means.

* * * * *